United States Patent [19]

Tsuchino et al.

[11] Patent Number: 4,825,085

[45] Date of Patent: Apr. 25, 1989

[54] RADIATION IMAGE STORAGE PANEL HAVING ASSEMBLED HEAT GENERATING BODY

[75] Inventors: Hisanori Tsuchino; Akiko Kano; Kuniaki Nakano; Fumio Shimada, all of Hino, Japan

[73] Assignee: Konica Corporation, Tokyo, Japan

[21] Appl. No.: 123,762

[22] Filed: Nov. 23, 1987

[30] Foreign Application Priority Data

Dec. 3, 1986 [JP] Japan ..... 61-289691

[51] Int. Cl.[4] ..... G21K 4/00

[52] U.S. Cl. ..... 250/484.1; 250/483.1

[58] Field of Search ..... 250/484.1 B, 484.1 R, 250/483.1, 327.2 A; 378/185

[56] References Cited

U.S. PATENT DOCUMENTS

| | | | |
|---|---|---|---|
| 3,859,527 | 1/1975 | Luckey | 250/327.2 |
| 4,090,085 | 5/1978 | Shimiya et al. | 250/483.1 |
| 4,236,078 | 11/1980 | Kotera et al. | 250/363 R |
| 4,501,683 | 2/1985 | Arakawa et al. | 252/301.26 |
| 4,741,993 | 5/1988 | Kano et al. | 430/536 |

FOREIGN PATENT DOCUMENTS

| | | | |
|---|---|---|---|
| 0273219 | 7/1988 | European Pat. Off. . | |
| 2638768 | 3/1977 | Fed. Rep. of Germany . | |
| 55-12144 | 1/1980 | Japan . | |
| 59-42500 | 3/1984 | Japan . | |
| 61-176900 | 8/1986 | Japan . | |
| 1237099 | 10/1986 | Japan | 250/484.1 B |
| 585470 | 12/1977 | U.S.S.R. | 378/185 |
| 1462769 | 1/1977 | United Kingdom . | |

*Primary Examiner*—Janice A. Howell
*Assistant Examiner*—Constantine Hannaher
*Attorney, Agent, or Firm*—Frishauf, Holtz, Goodman & Woodward

[57] ABSTRACT

Disclosed is a radiation image storage panel comprising a heat generating body for drying assembled in a radiation image storage panel using a light stimulable phosphor.

According to this invention, a radiation image storage panel which can stand uses for a long term can be obtained.

10 Claims, 8 Drawing Sheets

RADIATION IMAGE STORAGE PANEL HAVING ASSEMBLED HEAT GENERATING BODY

BACKGROUND OF THE INVENTION

This invention relates to a radiation image storage panel by use of a stimulable phosphor, more particularly to a radiation image storage panel which can stand uses for a long term.

Radiation image such as X-ray image has been frequently used for diagnosis of diseases, etc. For obtaining this X-ray image, the so-called radiation photography has been utilized, in which X-ray which has passed through a subject is irradiated on a phosphor layer (fluorescent screen), thereby forming visible light, and the visible light is irradiated on the film by use of a silver salt and developed similarly as in conventional photographing. However, in recent years, there has been contrived the method in which images are directly taken out from the phosphor layer without use of a film coated with a silver salt.

As this method, there is the method in which the radiation passed through a subject is absorbed in a phosphor, then the radiation energy stored by the above absorption in the phosphor is permitted to be radiated as fluorescence by excitation of the phosphor with, for example, light or heat energy, and the fluorescence is detected to form an image. Specifically, for example, U.S. Pat. No. 3,859,527 and Japanese Unexamined Patent Publication No. 12144/1980 disclose radiation image converting method with visible ray or IR-ray as the stimulating light by use of a stimulable phosphor. This method employs a radiation image storage panel having a stimulable phosphor layer formed on a support, and a latent image is formed by irradiating the radiation passed through a subject on the stimulable phosphor layer of the radiation image storage panel and accumulating the radiation energy corresponding to the transmission degree of the radiation at the respective portions of the subject, and thereafter the radiation energies stored at the respective portions are permitted to be radiated to be converted into light by scanning the stimulable phosphor layer with stimulating light, whereby images are obtained by the light signals according to intensity of the light. The final image may be reproduced as hard copy or reproduced on CRT.

The radiation image storage panel to be used in the radiation image converting method accumulates radiation image information and thereafter releases the stored energy by scanning of stimulating light, and therefore accumulation of radiation image can be again effected after scanning, thus enabling repeated uses.

Accordingly, the above radiation image storage panel should desirably have performances which can stand repeated uses for a long term or for a large number of times without deteriorating the image quality of the radiation image obtained. For this purpose, the stimulable phosphor layer in the above radiation image storage panel is required to be sufficiently protected from physical and chemical stimulations from outside.

Particularly, stimulable phosphors are strong in moisture absorption and when the above stimulable phosphor layer absorbs water, barium fluoride bromide type phosphor (e.g. BaFBr:Eu), etc. is decomposed to be lowered in sensitivity to radiation. Also, alkali halide type phosphors (e.g. RbBr:Tl), etc. are fluctuated in sensitivity to radiation by moisture absorption and dehumidication, and also increased or decreased in the fading speed of the radiation energy stored, whereby photographing conditions become unstable and also image quality of the radiation image obtained is deteriorated. For this reason, it has been desired to protect the above stimulable phosphor layer so that no water may be contained therein.

In the radiation image storage panel of the prior art, for solving the above problems, there has been employed a protective layer covering the stimulable phosphor layer, on the support of the radiation image storage panel.

This protective layer, as described in Japanese Unexamined Patent Publication No. 42500/1984, is formed by direct coating of a coating solution for protective layer on the stimulable phosphor layer, or alternatively by adhering a previously separately formed protective layer onto the stimulable phosphor layer.

Further, the present inventors have proposed in Japanese Unexamined Patent Publication No. 176900/1986 and Japanese Patent Application No. 156346/1985 a method for forming a protective layer by applying a coating solution for protective layer, containing a resin material which is cured by polycondensation or cross-linking reaction by irradiation of radiation and/or heating, on the stimulable phosphor layer and then curing the above resin material.

For increasing the life of the radiation image storage panel, further improvement, particularly in humidity resistance has been desired, but under the present situation, substantially no investigation has been made concerning moisture prevention except for the method for lowering moisture permeability of the above protective layer.

SUMMARY OF THE INVENTION

The present invention has been accomplished in view of the state of the art as described above in radiation image storage panel by use of a stimulable phosphor, and an object of the present invention is to provide a radiation image storage panel which remains in a good state for a long term while maintaining dryness of the stimulable phosphor layer.

The object of the present invention as mentioned above can be accomplished by a radiation image storage panel, comprising a heat generating body for drying in a radiation image storage panel by using a light stimulable phosphor.

As an embodiment of the present invention, the above heat generating body for drying may be contained as assembled in the constituent layer or the support of the radiation image storage panel, or alternatively a layer comprising a heat generating body may be separately provided.

DESCRIPTION OF THE PREFERRED EMBODIMENTS

Figure 1A:
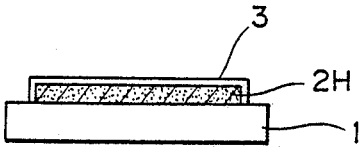
FIGS. 1 (*a*)–(*h*) are sectional views showing embodiments of the storage panel of the present invention.
Figure 1B:
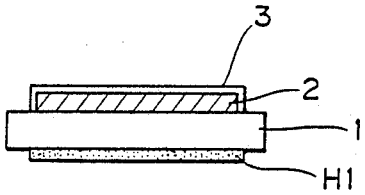
Figure 1C:
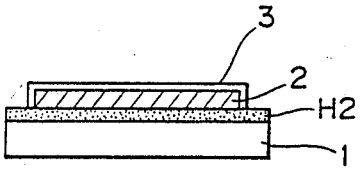
Figure 1D:
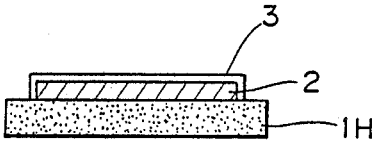
Figure 1E:
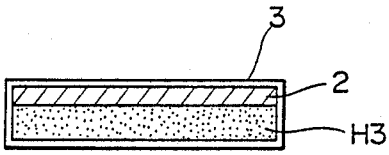
Figure 1F:
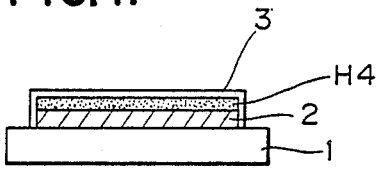
Figure 1G:
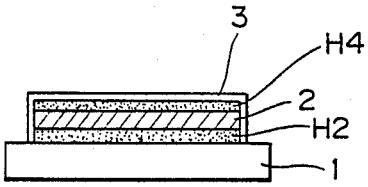
Figure 1H:
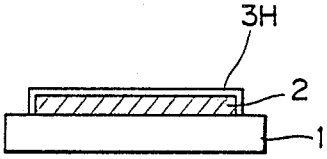

The radiation image storage panel by use of a light stimulable phosphor (hereinafter abbreviated as storage panel) comprises generally a light stimulable phosphor layer (hereinafter abbreviated as stimulation layer) and various constituent layers for assisting the function of said stimulation layer (e.g. protective layer, filter layer or adhesive layer, etc.) provided on a support.

FIGS. 1 (*a*)–(*h*) illustrate various embodiments of the storage panel of the present invention.

In FIG. 1 (*a*), 1 is a support, 2H is a heat generating stimulation layer comprising a heat generating body for drying (hereinafter abbreviated as heat generating body) assembled therein, 3 is a protective layer. Here, an example is shown in which said protective layer covers to the peripheral side surface of the stimulation layer. In FIG. 1 (*b*), a heat generating layer H1 comprising a heat generating body is provided on the back surface of the support 1 opposite to the stimulation layer 2 in contact with the support 1, and in FIG. 1 (*c*), a heat generating layer H2 comprising a heat generating body is provided on the same side as the stimulation layer 2 with respect-to the support and in contact with the support, the protective layer 3 covering the entire surface only of the stimulation layer 2. In FIG. 1 (*d*), 1H is a heat generating support comprising a heat generating body assembled in the support. In FIG. 1 (*e*), H3 is a supporting heat generating body in which the heat generating body itself also functions as the support, and the protective layer 3 covers the entire surface including the stimulation layer 2 and the back surface of the supporting heat generating body H3. In FIG. 1 (*f*), a heat generating layer H4 is provided in contact with the upper surface of the stimulation layer 2, while FIG. 1 (*g*) exhibits an embodiment in which the stimulation layer 2 is sandwiched between the heat generating layers H2 and H4. FIG. 1 (*h*) shows an example in which the heat generating protective layer 3H has a heat generating body assembled therein.

The storage panel of the present invention is not limited to the above examples, and when the layer comprising a heat generating body or containing a heat generating body assembled therein is in the form which is located on the protective layer side than the stimulation layer or is a protective layer as such and performs reading of image from the protective layer side, a transparent substance is used for said heat generating body.

The surface of the layer comprising a heat generating body or containing a heat generating body assembled therein may be a smooth surface or it can be also made a matte surface for the purpose of improving adhesiveness with the stimulation layer.

For the above layer containing a heat generating body assembled therein or the heat generating support, it is preferable to use an electroconductive fine powder of carbon black, a metal fine powder, etc.

Also, for the heat generating layer comprising a heat generating body, a thin film formed by vapor deposition or sputtering of a metal oxide of electrical resistor such as transparent indium oxide or metal, or a coated film of a coating material containing carbon black, metallic fine powder, etc. dispersed or suspended therein may be employed.

Also, for the supporting heat generating body, in which the above heat generating body itself also functions as the support, carbon fiber sheet, etc. may be employed.

The heating temperature range for drying or dehumidication of the storage panel may be 40° to 150° C., preferably 40° to 80° C., and within said temperature range, use of non-heat-resistant materials (e.g. polyethylene terephthalate, etc.) is freely permissible for the support and the protective layer. If the heating temperature is too high, loss may occur in the radiation energy accumulation in the stimulation layer during reading, or afterglow amount may be undesirably increased.

The timing for heating may be at any desired timing during reading for a stimulation of radiation image and/or during non-reading. The time required for drying can be about 1.0 to 2.0 hours at 80° C. even in the storage panel lowered to 30% relative sensitivity by containment of moisture, during which the sensitivity can be restored to approximately to 100%. The drying efficiency (sensitivity restoration speed) is better for the binder-free stimulation layer formed by vapor phase deposition.

It is also possible to take such measures as enhancing the heating temperature higher during non-reading than during reading to enhance the drying effect and image extinction efficiency, etc., and heating may be also discontinued during reading.

Also, a successive drying treatment may be performed every time for use, or alternatively comprehensive dehumidication treatment may be performed after a long time storage to the extent such that its function may not be restored during non-use at night, etc. or through the decomposition of the phosphor by moisture.

Figure 2A:
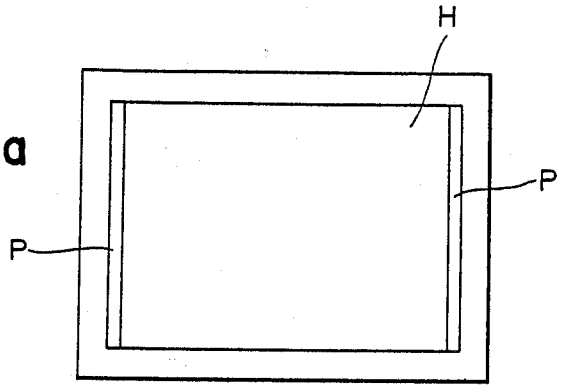
FIGS. 2 (*a*)–(*c*) are charts showing the circuit pattern of the heat generating body.
Figure 2B:
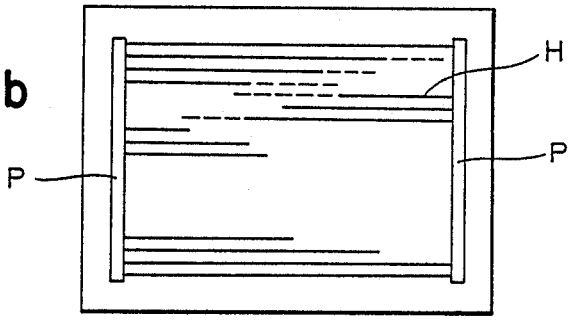
Figure 2C:
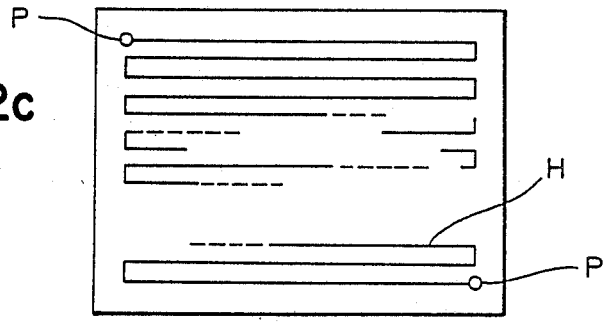

When a heat generating body is assembled in a storage panel as in the embodiment as described above, the heat generating body may take any desired pattern, provided that it is a form capable of forming a current circuit and having sufficient heating effect on the whole panel surface. Its examples are shown in FIGS. 2 (*a*)–(*c*). FIG. 2 (*a*) is an example in which a uniform thin layer circuit is formed in the heat generating body, FIG. 2 (*b*) is an example of a comb-type and FIG. 2 (*c*) is an example of a bent single wire type circuit. In FIGS. 2 (*a*)–(*c*) P is electrode and H is heat generating body.

Figure 3:
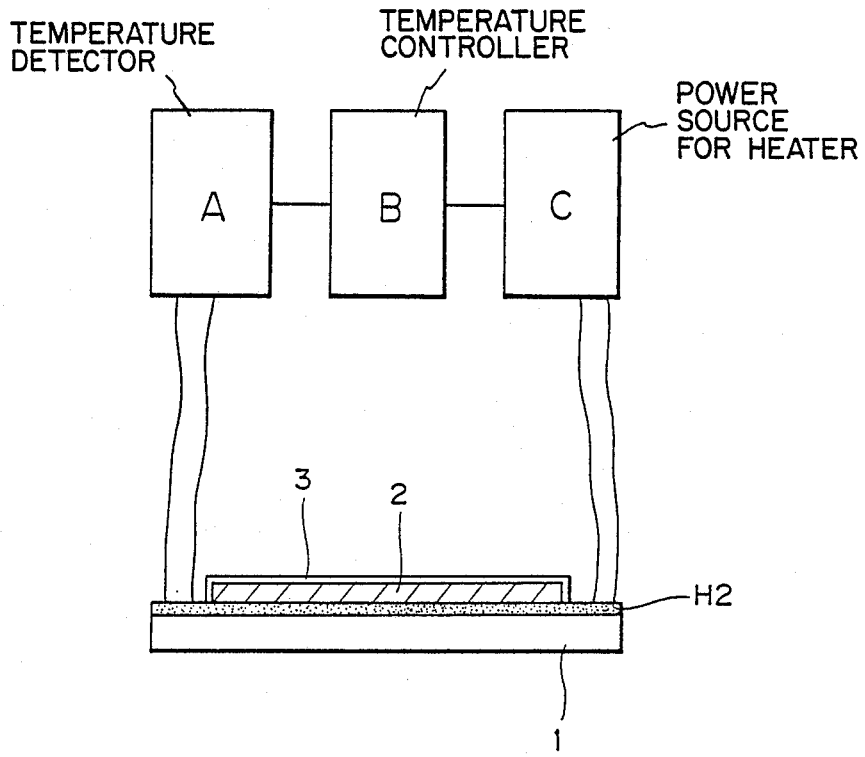
FIG. 3 is a block diagram of temperature control.

Next, drying temperature control of the storage panel can be easily done by combining a temperature detector such as a thermocouple, etc. with a temperature controller, a power source for heater. FIG. 3 shows a block diagram of one example thereof. In FIG. 3, 1 is a support, 2 a stimulation layer, 3 a protective layer, A a temperature detector, B a temperature controller, C a power source for heater and H2 a heat generating layer.

The storage panel of the present invention as described in detail above is particularly suitable for utilization in an exposure-reading built in type radiation image reading device having a stimulable phosphor plate built therein, but it can be also utilized in the case in which photographing and reading apparatus are constituted separately.

Also in the case of separate devices, heating and drying devices may be used.

Figure 4:
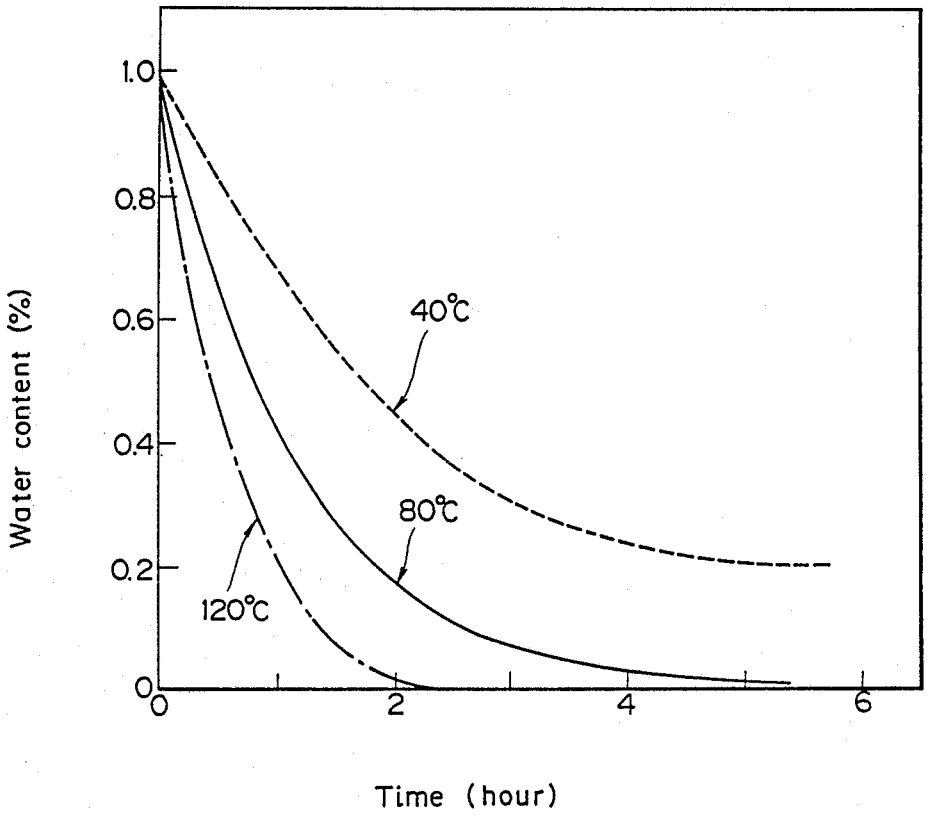
FIG. 4 is a graph showing a dehumidication efficiency of the stimulation layer of the storage panel.

Next, one example of dehumidication efficiency of the storage panel of the present invention is shown in FIG. 4. The structure of said storage panel is constituted as in FIG. 1 (*c*), and RbBr: T1 phosphor is used as the light stimulable phosphor.

Figure 5:
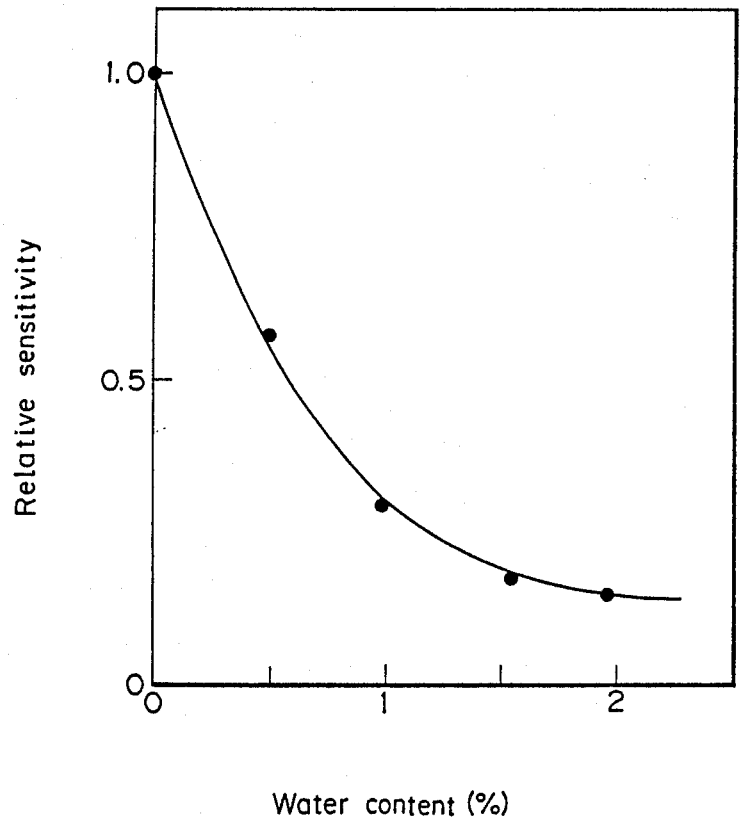
FIG. 5 is a graph showing the relationship between the water content and sensitivity of the stimulation layer.

Also, FIG. 5 shows the relationship between the water content in the stimulation layer of the above storage panel (water mg/stimulation layer 2) and sensitivity.

As is apparent from the figures, by heating of the stimulation layer, dehumidication and moisture prevention of said layer are effected to ensure permanent characteristics during usage of the storage panel.

As the support to be used in the storage panel of the present invention, various polymeric materials, glasses, metals, etc. may be employed. In handling of information recording materials, those which can be worked into sheets or webs having flexibility may be employed, and from this point it is preferable to use plastic films such as cellulose acetate film, polyester film, polyethylene terephthalate film, polyamide film, polyimide film, triacetate film, polycarbonate film, etc.; metal sheets such as of aluminum, iron, copper, chromium, etc. or metal sheets having coated layers of said metal oxides.

The layer thickness of these supports, which may differ depending on the material of the support, may be generally 80 μm to 1000 μm, more preferably 80 μm to 500 μm from the point in handling.

The surface of these supports may be a smooth surface, or it can be also made a matte surface for the purpose of improving adhesiveness with the stimulation layer or the heat generating layer. Also, the surface of the support can be made uneven surface or it may be also made a structure with minute tile-shaped plates separated from each other being spread.

Further, these supports may have also a subbing layer provided on the surface where the stimulation layer is provided for further improvement of adhesiveness with the stimulation layer.

Generally speaking, stimulable phosphor in a storage panel refers to a phosphor which exhibits stimulated emission corresponding to the dose of the initial light or radiation of high energy by optical, thermal, mechanical, chemical or electrical stimulation after irradiation of initial light or high energy radiation, but practically it includes light stimulable and heat stimulable phosphors as the main ones.

In the storage panel by use of the above heat stimulable phosphor, a heat generating mechanism is assembled or taken in to effect image reading by heat excitation of the stored radiation image. The heat content to be used for a heat excitation is not a heat content enough to dry the phosphor of the storage panel at all within the heat excitation time of at most second unit.

For the reasons as mentioned above, the heat stimulable phosphor is slow in response to excitation and can be read in time series with difficulty, etc., practically light stimulable phosphor is useful, and those which effect a stimulated emission with stimulating light of 500 nm or higher are preferred.

As the light stimulable phosphor to be used in the storage panel of the present invention, there may be included alkaline earth fluoride halide phosphors represented by the formula:

$$(Ba_{1-x-y}Mg_xCa_y)FX:eEu^{2+}$$

(wherein X is at least one of Br and Cl, x, y and e are numbers satisfying the conditions of $0<x+y\leqq 0.6$, xy $\neq 0$ and $10^{-6}\leqq e\leqq 5\times 10^{-2}$) disclosed in Japanese Unexamined Patent Publication No. 12143/1980; phosphors represented by the formula:

$$LnOX:xA$$

(wherein Ln represents at least one of La, Y, Gd and Lu, X Cl and/or Br, A Ce and/or Tb, x is a number satisfying $0<x<0.1$) disclosed in Japanese Unexamined Patent Publication No. 12144/1980; phosphors represented by the formula:

$$(Ba_{1-x}M^{II}_x)FX:yA$$

(wherein $M^{II}$ represents at least one of Mg, Ca, Sr, Zn and Cd, X at least one of Cl, Br and I, A at least one of Eu, Tb, Ce, Tm, Dy, Pr, Ho, Nd, Yb, and Er, x and y are numbers satisfying the conditions of $0\leqq x\leqq 0.6$ and $0\leqq y\leqq 0.2$) disclosed in Japanese Unexamined Patent Publication No. 12145/1980; phosphors represented by the formula:

$$BaFX:xCe,yA$$

(wherein X represents at least one of Cl, Br and I, A at least one of In, Tl, Gd, Sm and Zr, x and y respectively $0<x\leqq 2\times 10^{-1}$ and $0<y\leqq 5\times 10^{-2}$) disclosed in Japanese Unexamined Patent Publication No. 84389/1980; rare earth element activated divalent metal fluorohalide phosphors represented by the formula:

$$M^{II}FX\cdot xA:yLn$$

(wherein $M^{II}$ represents at least one of Mg, Ca, Ba, Sr, Zn and Cd, A at least one of BeO, MgO, CaO, SrO, BaO, ZnO, $Al_2O_3$, $Y_2O_3$, $La_2O_3$, $In_2O_3$, $SiO_2$, $TiO_2$, $ZrO_2$, $GeO_2$, $SnO_2$, $Nb_2O_5$ and $ThO_2$, Ln at least one of Eu, Tb, Ce, Tm, Dy, Pr, Ho, Nd, Yb, Er, Sm and Gd, X at least one of Cl, Br and I, x and y are numbers satisfying the conditions of $5\times 10^{-5}\leqq x\leqq 0.5$ and $0<y\leqq 0.2$) disclosed in Japanese Unexamined Patent Publication No. 160078/1980; phosphors represented by either one of the following formulae:

$$xM_3(PO_4)_2\cdot NX_2:yA$$

$$M_3(PO_4)_2:yA$$

(wherein each of M and N represents at least one of Mg, Ca, Sr, Ba, Zn and Cd, X at least one of F, Cl, Br and I, A at least one of Eu, Tb, Ce, Tm, Dy, Pr, Ho, Nd, Yb, Er, Sb, Tl, Mn and Sn and x and y are numbers satisfying the conditions of $0<x\leqq 6$ and $0\leqq y\leqq 1$); phosphors represented by either one of the following formulae:

$$nReX_3\cdot mAX'_2:xEu$$

$$nReX_3\cdot mAX'_2:xEu,ySm$$

(wherein Re is at least one of La, Gd, Y and Lu, A at least one of alkaline earth metals, Ba, Sr and Ca, X and X' each at least one of F, Cl and Br, x and y are numbers satisfying the conditions of $1\times 10^{-4}<x<3\times 10^{-1}$ and $1\times 10^{-4}<y<1\times 10^{-1}$, and n/m satisfies the condition of $1\times 10^{-3}<n/m<7\times 10^{-1}$); and alkali halide phosphors represented by the following formula:

$$M^{I}X\cdot am^{II}X'_2\cdot bm^{III}X''_3:cA$$

(wherein $M^I$ is at least one alkali metal selected from Li, Na, K, Rb and Cs, $M^{II}$ at least one divalent metal selected from Be, Mg, Ca, Sr, Ba, Zn, Cd, Cu and Ni, $M^{III}$ at least one trivalent metal selected from Sc, Y, La, Ce, Pr, Nd, Pm, Sm, Eu, Gd, Tb, Dy, Ho, Er, Tm, Yb, Lu, Al, Ga, and In. X, X' and X'' are each at least one halogen selected from F, Cl, Br and I, A is at least one metal selected from Eu, Tb, Ce, Tm, Dy, Pr, Ho, Nd, Yb, Er, Gd, Lu, Sm, Y, Tl, Na, Ag, Cu and Mg, a is a numerical value within the range of $0 \leqq a < 0.5$, b is a numerical value within the range of $0 \leqq b < 0.5$, and c is a numerical value within the range of $0 < c \leqq 0.2$) disclosed in Japanese Unexamined Patent Publication No. 148285/1982. Particularly, alkali halide phosphors are preferred, since a stimulation layer can be formed easily according to the method such as vapor deposition, sputtering, etc.

However, the light stimulable phosphor to be used in the storage panel of the present invention is not limited to the phosphors as described above, but any phosphor which is a phosphor capable of exhibiting stimulated emission when stimulating light is irradiated after irradiation may be employed.

The storage panel of the present invention may have a group of stimulation layers comprising one or two or more stimulation layers containing at least one of the light stimulable phosphors as mentioned above. Also, the stimulable phosphors contained in the respective stimulation layers may be the same or different from each other.

The above stimulation layer may be formed on the support at the layered portion containing no binder by vapor deposition, sputtering, etc. of the light stimulable phosphor as described in Japanese Unexamined Patent Publication No. 73100/1986, or alternatively, the stimulable phosphor may be dispersed in a suitable binder to prepare a coating solution and coating it on the support. When a binder is used in the storage panel of the present invention, there may be employed binders conventionally used for layer constitution, including proteins such as gelatin, polysaccharides such as dextran or gum arabic, polyvinyl butyrate, polyvinyl acetate, nitrocellulose, ethyl cellulose, vinylidene chloridevinyl chloride copolymer, polymethyl methacrylate, vinyl chloridevinyl acetate copolymer, polyurethane, cellulose acetate butyrate, polyvinyl alcohol, etc.

However, concerning the storage panel of the present invention, as particularly proposed in the above Japanese Unexamined Patent Publication No. 73100/1986, the stimulation layer should have a structure containing no binder. As the method for forming the stimulation layer containing no binder, the following methods may be included.

As the first method, there is the vapor deposition method. In said method, a support is first placed in the vapor deposition device and then the device is internally evacuated to a vaccum degree of about $10^{-6}$ Torr. Subsequently, at least one of the above light stimulable phosphors is evaporated by heating according to the method such as the resistance heating method, the electron beam method, etc. to deposit a light stimulable phosphor to a desired thickness on the above support surface.

As a consequence, a stimulation layer containing no binder is formed, but it is also possible to form the stimulation layer in divided plural times in the above vapor deposition step. Also, in the above vapor deposition step, it is possible to perform co-vapor deposition by use of a plural number of resistance heaters or electron beams.

Also, in the above vapor deposition method, the starting materials for the light stimulable phosphor can be co-vapor deposited by use of a plural number of resistance heaters or electron beams, whereby the desired light stimulable phosphor can be synthesized simultaneously with formation of the stimulation layer on the support.

Further, in the above vapor deposition method, the material to be deposited may be cooled or heated if desired during vapor deposition. Also, the stimulation may be subjected to heat treatment after completion of the vapor deposition.

As the second method, there is the sputtering method. In said method, similarly as the vapor deposition method, after the support is placed in a sputtering device, the device is once internally evacuated to a evacuation degree of about $10^{-6}$ Torr, and subsequently an inert gas such as Ar, Ne, etc. as the gas for sputtering is introduced into the sputtering device to control the gas pressure at about $10^{-3}$ Torr.

Next, by effecting sputtering with the above light stimulable phosphor as the target, the light stimulable phosphor is deposited to a desired thickness on the above support surface, whereby the stimulation layer can be formed similarly as the above vapor deposition method.

As the third method, there is the CVD method. According to said method, by decomposing the light stimulable phosphor or the organic metal compound containing the starting materials for the light stimulable phosphor with an energy such as heat, high frequency power, etc., a stimulable layer containing no binder can be obtained on the support.

As the fourth method, there is the blowing method. According to said method, by blowing light stimulable phosphor powder onto a tacky layer, a stimulation layer containing no binder is obtained on the support.

The layer thickness of the stimulation layer of the storage panel of the present invention may differ depending on the sensitivity of the storage panel to radiation, the kind of the light stimulable phosphor, etc., but it may be within the range from 10 μm to 1000 μm when containing no binder, more preferably from 20 μm to 800 μm, and preferably within the range from 10 μm to 1000 μm when containing a binder, more preferably from 20 μm to 500 μm.

The storage panel of the present invention can take various structures for the purpose of improving sharpness of the radiation image obtained. For example, there may be included the structure such that the stimulation layer has fine columnar block structure extending substantially in the vertical direction to the above support surface as described in Japanese Unexamined Patent Publication No. 246700/1986; the structure comprising a support having a large number of fine uneven patterns and a stimulation layer comprising fine columnar block structure having the above surface structure as such on the above support as disclosed in Japanese Unexamined Patent Publication No. 142497/1986; the structure comprising a support having a surface structure such that a large number of minute tile-shaped plates are spread as separated with fine intervals from each other, and a stimulation layer comprising fine columnar block structure having the above surface structure as such on the above support as described in Japanese Unexamined Patent Publication No. 142498/1986; the structure comprising a large number of minute tile-shaped plates and a fine network which sectionalizes the respective fine tile-shaped plates surrounding around said fine tile-shaped plates and a stimulation layer with fine columnar block structure of stimulable phosphors extending in the thickness direction on said fine tile-shaped plates as described in Japanese Unexamined Patent Publication No. 142499/1986; the structure provided with a stimulation layer comprising a fine columnar block structure having crevasses developed from the intervals of the fine tile-shaped plates toward the layer surface, said crevasses being developed by application of shock treatment on the stimulation layer deposited in the thickness direction on the surface of the fine tile-shaped surfaces which are scattered from each other with intervals as distributed in a large number on the support surface as described in Japanese Unexamined Patent Publication No. 142500/1986.

Also, for the purpose of improving sharpness of the radiation image obtained in the storage panel of the present invention, white powder may be contained in the stimulation layer, and also the stimulation layer may be colored with a colorant which can absorb the stimulating light. Also, between the support and the stimulation layer, a light reflective layer containing white filler may be provided.

Next, it is preferable to provide a protective layer on the surface opposite to the support side of the stimulation layer and on other surfaces, if desired. As the method for forming the protective layer, the methods as described below may be employed.

As the first method, there is the method as disclosed in Japanese Unexamined Patent Publication No. 42500/1984 in which a protective layer is formed by coating the surface on which the protective layer is to be placed with a solution prepared by dissolving a highly transparent polymeric substance in a suitable solvent, followed by drying.

As the second method, there is the method similarly as disclosed in Japanese Unexamined Patent Publication No. 42500/1984 in which a suitable adhesive is imparted to one surface of the thin film comprising a transparent polymeric substance and adhered on the surface on which the protective layer is to be provided.

As the material for a protective layer to be used in the first and the second methods, there may be included, for example, cellulose derivatives such as cellulose acetate, nitrocellulose, ethyl cellulose, etc., or polymethyl methacrylate, polyvinyl butyral, polyvinyl formal, polycarbonate, polyvinyl acetate, polyacrylonitrile, polymethylallyl alcohol, polymethyl vinyl ketone, cellulose diacetate, cellulose triacetate, polyvinyl alcohol, polyacrylic acid, polymethacrylic acid, polyglycine, polyacrylamide, polyvinylpyrrolidone, polyvinylamine, polyethylene terephthalate, polyethylene, polyvinylidene chloride, polyvinyl chloride, polyamide (nylon), polytetrafluoroethylene, poly-fluorochloroethylene, polypropylene, tetrafluoroethylenehexafluoropropylene copolymer, polyvinyl isobutyl ether, polystyrene, etc.

As the third method, there is the method as described in Japanese Unexamined Patent Publication No. 176900/1986 in which a coating solution containing at least one of radiation curing type resin or thermosetting resin is coated on the surface on which the protective layer is to be provided, and the above coating solution is cured by application of irradiation of radiation such as UV-ray or electron beam and/or heating by means of a device as shown in Japanese Unexamined Patent Publication No. 176900/1986.

As the above radiation curing type resin, there may be included compounds having unsaturated bouble bonds or compositions containing such compounds, and examples of such compounds may be preferably prepolymers and/or oligomers having two or more unsaturated double bonds, and further monomers having unsaturated double bonds (vinyl monomers) can be contained therein as the reactive diluent.

The layer thickness of one layer of the protective layer formed according to the above first, second and third methods may be preferably within the range from about 1 μm to 1000 μm, more preferably from about 2 μm to 50 μm.

As the fourth method, there is the method in which an inorganic substance layer such as of $SiO_2$, SiC, SiN, $Al_2O_3$, etc. is formed by the vaccum vapor deposition method, the sputtering method, etc. The above inorganic substance layer should preferably have a layer thickness of about 0.1 μm to 100 μm.

The storage panel of the present invention may be prepared by first providing a stimulation layer on a support and then forming a protective layer on said stimulation layer, or alternatively by providing the previously formed protective layer by attachment on the above stimulation layer. Alternatively, there may be also employed the procedure in which the support is provided after formation of the stimulation layer on the protective layer.

In the storage panel of the present invention, the protective layer may also comprise a combination of two or more layers with different moisture absorptions. Of the above protective layers, as the material to be used for the protective layer with relatively smaller moisture absorption, there may be preferably used, for example, polyethylene, polytetrafluoroethylene, polytrifluorochloroethylene, polypropylene, tetrafluoroethylenehexafluoropropylene copolymer, polyvinylidene chloride, polyvinyl isobutyl ether, polyethylene terephthalate, vinylidene chloride-vinyl chloride copolymer, vinylidene chloride-acrylonitrile copolymer, vinylidene chlorideisobutylene copolymer, polystyrene, epoxy type polymers and acrylic polymers, etc. On the other hand, as the material to be used for the protective layer with relatively greater moisture absorption, there may be preferably used, for example, polyvinyl alcohol, polyacrylamide, polyglycine, polymethacrylic acid, polyacrylic acid, polyvinylpyrrolidone, polyvinylamine, cellulose diacetate, cellulose triacetate, nylon 4, nylon 6, nylon 12, nylon 66, polyvinyl acetate, polymethylallyl alcohol, etc.

Of the embodiments of the present invention, preferred is a storage panel having a composite protective layer in which at least one is selected from among the materials of the group as mentioned above as the material for protective layer with smaller absorption and also at least one is selected from among the materials for protective layer with greater moisture absorption, and the former is arranged on the outside and the latter inside, namely, on the side in contact with the stimulation layer.

Figure 6:
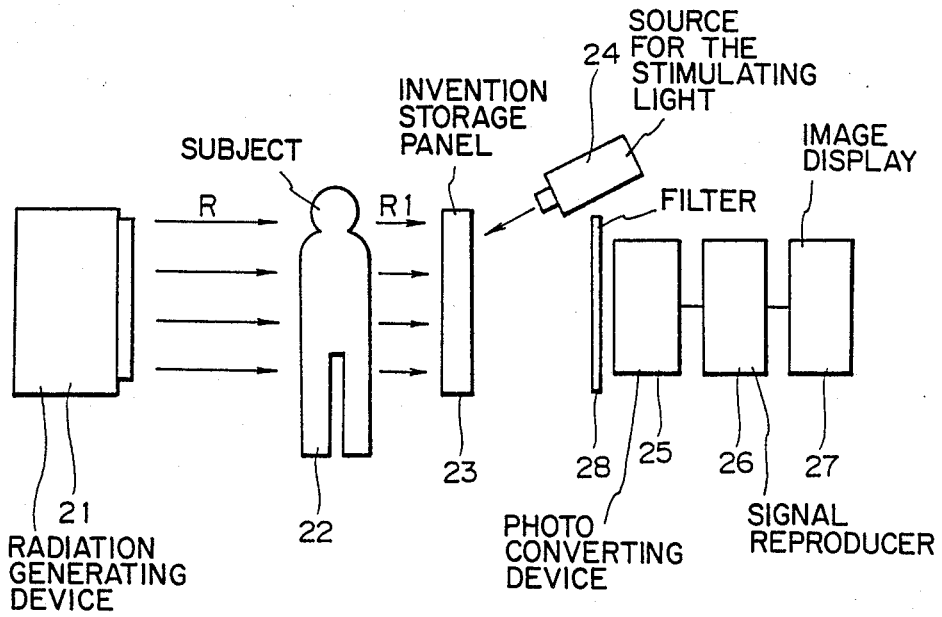
FIG. 6 is a schematic illustration for explanation of the radiation image reading method by use of the storage panel of the present invention.

The storage panel of the present invention is used in the radiation image converting method as schematically shown in FIG. 6. More specifically, in FIG. 6, 21 is a radiation generating device, 22 a subject, 23 a storage panel of the present invention, 24 a source for stimulating light, 25 a photoconverting device for detection of the stimulated emission radiated from said storage panel, 26 a device for reproducing the signal detected in 25 as the image, 27 a device for displaying the reproduced image, 28 a filter which separates stimulating light from stimulated emission and transmits only the stimulated emission. The members of 25 et seq. may be any of the members which can reproduce the light information from 23 as the image in some form, and the above members are not limitative of the present invention.

As shown in FIG. 6, from the radiation generating device 21 enters the storage panel 23 through the subject 22. The incident radiation is absorbed by the stimulation layer of the storage panel 23, and its energy is stored to form a stored image of the radiation transmitted image. Next, the stored image is excited by the stimulating light from the stimulating light source 24 to release it as the stimulated emission.

The intensity of the stimulated emission released is proportional to the energy amount of the radiation stored, and the light signal can be subjected to photoconverting by a photoconverting device 25 such as photoelectric multiplier, etc., reproduced as the image by the image reproducing device 26 and displayed by the displaying device 27, whereby the radiation transmitted image of the subject can be observed.

EXAMPLES

The present invention is described below by referring to Examples.

EXAMPLE 1

As the support, a chemical reinforced glass with the thickness of 500 μm was placed in a vapor deposition vessel. Next, an alkali halide light stimulable phosphor (0.9RbBr.0.1CsF:0.01T1) was placed in a tungsten boat for a resistance heating, and set on the electrodes for a resistance heating, followed subsequently by evacuation of the vapor deposition vessel to a vaccum degree of $2\times 10^{-6}$ Torr.

Next, a current was passed through the tungusten boat, and the alkali halide light stimulable phosphor was evaporated by the resistance heating method to be deposited on the chemical reinforced glass until the layer thickness of the stimulation layer became a thickness of 300 μm.

Next, after the panel was taken out in the air, on the surface where no stimulation layer of the chemical reinforced glass was provided, an electroconductive film sheet having ITO (Indium Tin Oxide) vapor deposited on a polyimide film (produced by Micro Gijutsu Kenkyusho, 10Ω/□) was adhered, while on the stimulation layer surface a transparent polyethylene terephthalate sheet with the thickness of 20 μm was adhered, to give a storage panel A of the present invention with the structure as shown in FIG. 1 (*b*).

Figure 7:
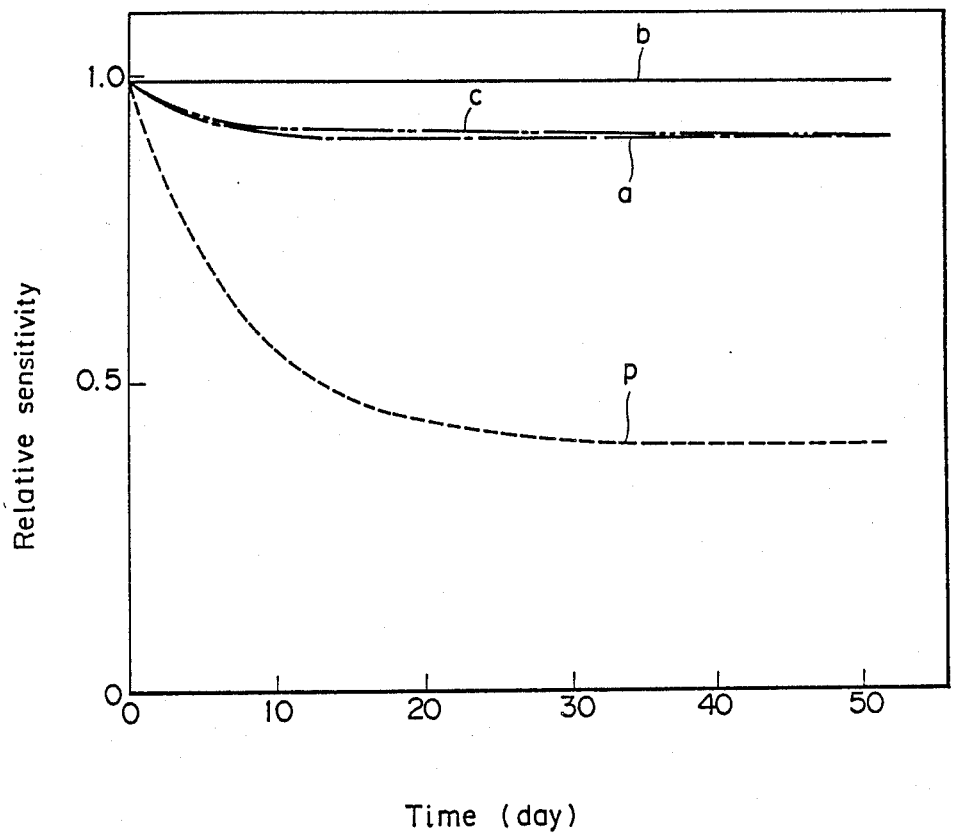
FIG. 7 illustrates the temperature effect against moisture prevention.

The storage panel A was mounted with electrodes and a temperature control circuit as shown in FIG. 3, and left to stand in a thermostat chamber of 30° C. and relative humidity of 70% while heating the stimulation layer to 80° C., and the sensitivity change with lapse of time was measured to obtain the results as shown in FIG. 7 curve a.

EXAMPLE 2

In Example 1, the heating of the stimulation layer was conducted at 140° C., and following otherwise the same procedure as in Example 1, sensitivity change with lapse of time was measured to obtain FIG. 7 curve b.

EXAMPLE 3

In Example 1, on the side where the stimulation layer is to be provided previously as the support, a chemical reinforced glass with the thickness of 500 μm having a transparent electroconductive film (ITO, 10Ω/□) vapor deposited thereon was used, and following otherwise the same procedure as in Example 1, a storage panel B of the present invention was obtained. On the transparent electroconductive film, a SiO film (2000 Å) for prevention of the reaction between the transparent electroconductive film and the light stimulable phosphor was provided. Next, the sensitivity change with lapse of time of the storage panel B was measured in the same manner as in Example 1 to obtain the results shown in FIG. 7 curve c.

COMPARATIVE EXAMPLE 1

The stimulation layer of the storage panel A prepared in Example 1 was left to stand in a thermostat chamber of 30° C. and relative humidity of 70% without heating, and the sensitivity change with lapse of time was measured to obtain the results shown in FIG. 7 curve p.

From FIG. 7, it can be seen that the storage panel of the present invention prevents lowering in sensitivity by moisture absorption by heating the stimulation layer, whereby permanent characteristic during usage can be ensured.

EXAMPLE 4

By mixing and dispersing 8 parts by weight of an alkali halide light stimulable phosphor (0.9RbBr.0.1CsF: 0.01Tl), 1 part by weight of a polyvinyl butyral resin and 5 parts by weight of a solvent (cyclohexanone), a coating solution for stimulation layer was prepared.

Next, the coating solution was applied uniformly on a chemical reinforced glass support with the thickness of 500 μm placed horizontally, and dried naturally to form a stimulation layer with the thickness of 300 μm.

On the surface where no stimulation layer of chemical reinforced glass of the thus obtained panel is provided, the same electroconductive sheet as in Example 1 was adhered, while on the stimulation layer surface, a transparent polyethylene terephthalate sheet with the thickness of 20 μm was adhered to give a storage panel C of the present invention.

After the storage panel A of Example 1 and the storage panel C of this Example were left to stand for a sufficiently long term in a thermostat chamber of 30° C. and relative humidity of 80%, they were taken out in a thermostat chamber of 30° C. and relative humidity of 60%, mounted with a temperature control circuit as shown in FIG. 3, and the stimulation layer was heated to 80° C. for examination of how the sensitivities of the above storage panels A, C were restored. The results are shown in FIG. 8 curve d (storage panel A), curve e (storage panel C).

COMPARATIVE EXAMPLE 2

After the storage panel A of Example 1 was left to stand similarly as in Example 4 for a sufficiently long term in a thermostat chamber of 30° C. and relative humidity of 80%, it was taken out in a thermostat chamber of 30° C. and relative humidity of 60%, and the state of sensitivity restoration of the above storage panel A was examined without heating the stimulation layer. The results are shown in FIG. 8 curve q.

Figure 8:
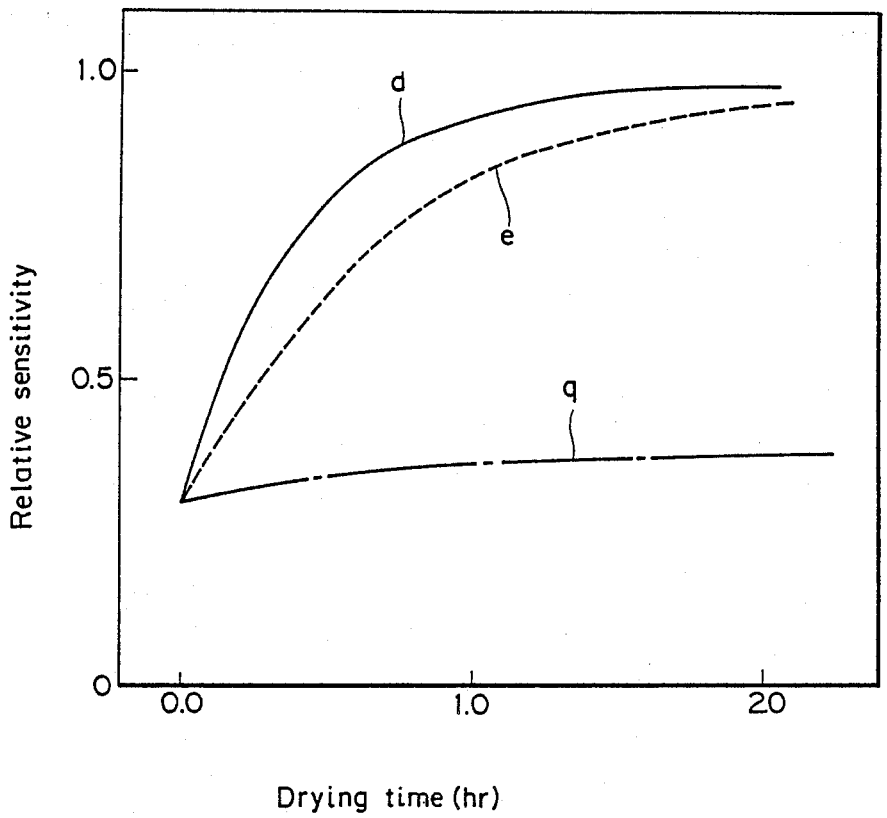
FIG. 8 is a graph showing the sensitivity restoration behaviors by heating.

From FIG. 8, it can be understood that the storage panel of the present invention can be restored in sensitivity by heating of the stimulation layer, even if the sensitivity may be once lowered. Of the storage panels of the present invention, the storage panel A can be restored in sensitivity more rapidly, because no binder is contained therein.

As described above, the storage panel of the present invention having a heating mechanism built therein has preferable behaviors as follows:

(1) By heatin, absorption of moisture onto the stimulable phosphor can be prevented, whereby lowering in sensitivity to radiation, increase of fading, etc. can be inhibited;

(2) By heating, moisture absorbed onto the stimulable phosphor is released, whereby the deteriorated performance of the stimulable phosphor by moisture absorption can be restored;

(3) By heating, the stored energy at trap level which causes long life afterglow is released before reading, whereby the afterglow is reduced to improve S/N; whereby permanent characteristics during usage of the storage panel can be improved.

We claim:

1. A radiation image storage panel, comprising a heat generating body for drying assembled in a radiation image storage panel using a light stimulable phosphor.

2. The radiation image storage panel according to claim 1, wherein said heat generating body for drying is provided in contact with a support of the radiation image storage panel.

3. The radiation image storage panel according to claim 1, wherein said heat generating body for drying is provided in contact with a light stimulable phosphor layer of the radiation image storage panel.

4. The radiation image storage panel according to claim 3, wherein said heat generating body for drying is provided in contact with a support of the radiation image storage panel.

5. The radiation image storage panel according to claim 1, wherein said heat generating body for drying also functions as a support of said radiation image storage panel.

6. The radiation image storage panel according to claim 1, wherein said heat generating body for drying also functions as a protective layer of said radiation image storage panel.

7. The radiation image storage panel according to claim 6, wherein said heat generating body is a transparent substance.

8. The radiation image storage panel according to claim 1, wherein said heat generating body comprises a thin film formed by vapor deposition or sputtering of a metal oxide of electrical resistor, or a coated film of a coating material containing carbon black or metallic fine powder dispersed or suspended therein.

9. The radiation image storage panel of claim 8, wherein heat generating body comprises the thin film of metal oxide, and said metal oxide is indium oxide or indium tin oxide.

10. The radiation image storage panel of claim 8 wherein the heat generating body comprises said coated film containing carbon black dispersed or suspended therein.

* * * * *